United States Patent [19]

Sieloff

[11] 4,135,653

[45] Jan. 23, 1979

[54] ARMBAND ASSEMBLY FOR CARRYING A PORTABLE RADIO

[76] Inventor: Norman T. Sieloff, 22125 Margareta, Detroit, Mich. 48219

[21] Appl. No.: 757,518

[22] Filed: Jan. 7, 1977

[51] Int. Cl.[2] ..... A45C 11/00

[52] U.S. Cl. ..... 224/5 H; 224/26·R

[58] Field of Search ..... 224/5 H, 5 R, 26 R, 224/26 G, 26 K, 26 B, 23, 28 R, 28 B, 28 A, 5 D, 5 A, 5 V, 5 Q, 5 MA, 5 W, 13, 14, 21, 22, 23, 20, 26 F, 26 J, 2 B; 150/52 J, 52 R

[56] References Cited

U.S. PATENT DOCUMENTS

| | | | |
|---|---|---|---|
| D. 238,725 | 2/1976 | Zerobnick | 224/5 R X |
| 896,264 | 8/1908 | Auslander | 224/28 W |
| 967,487 | 8/1910 | Baker | 224/26 D |
| 1,234,859 | 7/1917 | Blake | 224/26 K UX |
| 1,689,396 | 10/1928 | Lang | 224/28 B UX |
| 2,096,376 | 10/1937 | Lauppe | 224/5 H |
| 2,304,367 | 12/1942 | Meyer et al. | 224/5 H |
| 2,625,192 | 1/1953 | Kinskie | 224/5 H |

*Primary Examiner*—Trygve M. Blix
*Assistant Examiner*—Jerold M. Forsberg
*Attorney, Agent, or Firm*—C. Paul Padgett, Jr.

[57] ABSTRACT

An armband assembly adapted to be transportively worn about a person's arm for carrying a portable radio in such a position that either the person is able to hear the audio sounds generated by the radio directly or else the fixed length electrical cord of the ear plug assembly is able to comfortably reach from the ear plug adapted to be retainably inserted within the person's ear to the jackplug of the radio for operative connection thereto. The armband assembly includes a first strap assembly for retainably encircling the person's arm to be transportively carried thereon and a second assembly fixedly secured to the first strap assembly for at least partially enclosing the radio so as to retainably mount the radio with respect to the first band assembly thereby enabling the radio to be transportively carried by the person's arm so as to provide him with readily available audio sounds while leaving his hands free for manual tasks and the like.

5 Claims, 5 Drawing Figures

ARMBAND ASSEMBLY FOR CARRYING A PORTABLE RADIO

BACKGROUND OF THE INVENTION

The present invention relates to an apparatus for carrying a portable radio, and more particularly to an armband assembly having a first strap means which can be selectively adjusted to retainably encircle a person's arm to be transportively carried thereon and a second strap means fixedly secured to the first strap means for mounting the radio with respect to the first strap means.

The present invention is particularly useful in applications wherein the person who desires continual access to a radio is engaged in manual tasks requiring the use of his hands such as riding a motorcycle or bicycle, carrying articles and the like.

The prior art teaches many different types of portable radio cases having handles or hangstraps to be used by the person carrying the radio. In most applications, the radio must be hand-held at a level higher than normal arms length or else the person is unable to directly hear the sounds generated by the radio and/or the ear plug cord is usually of insufficient length to reach from an arms length carried position to the person's ear.

The prior art also teaches the use of pockets on the person's clothing to carry portable radios, however pockets have the disadvantage of muffling the sound generated directly by the radio since the material of the pocket normally absorbs sound and masks the radios speaker. Additionally, the pocket normally interferes with the ability of the person to adjust the control dials and/or interferes with the ear plug cord passing from the radio to the person's ear. Control adjustments are extremely difficult and the radio must normally be removed from the pocket for such adjustments to be made, often resulting in a hazardous situation such as where the person is engaged in driving a motor vehicle, bicycle or the like.

Several types of radio carriers exist in the prior art which are adapted to be mounted on a bicycle, motorcycle or the like to enable the rider's hands to be free. Most such carriers are mechanically complex and expensive, and often are dangerous if the bicycle or motorcycle is involved in an accident since edges of the carrier assembly may protrude and tend to cause injury. Additionally, most such carriers are mounted on the cross-bar adjacent the seat or on the handlebars of the bicycle or motorcycle, and while the volume of the radio may be sufficient to allow the person to hear the audio sound generated by the radio for bicycle operation, it would seldom if ever be sufficient for use with a motorcycle, minibike or the like.

Additionally, the typical prior art mounting locations are too far from the rider's ear to enable the ear plug cord assembly to comfortably reach from the ear to the radio, and even if it were possible, a dangerous condition could be created if an accident were to occur since the radio would be attached to the motorcycle, bicycle or the like while the ear plug is insertably retained within the person's ear.

Most of the other radio carriers of the prior art which are adapted to be carried by the person desiring continual access to a radio involve clips or means for mounting the radio at a position remote from the wearer's ear which would prohibit use of the ear plug assembly normally accompanying the radio and which would normally prevent the user being able to hear the audio sounds generated by the radio under many different conditions, such as when the user is driving a motorcycle, minibike or the like. Similarly, the other prior art devices often carry the radio in such a position that access to the control dials and/or to the jackplug it is partially or totally obstructed. Many such devices are expensive, difficult to mount or difficult to maintain. Lastly, the radio may not be adequately secured or mounted which may result in its coming loose and falling which can result in injury or damage to the radio.

The present invention eliminates most of the deficiencies of the prior art and provides a selectively adjustable and relatively secure armband assembly for carrying a portable radio in a suitable position on the person's arm leaving his hands free for manual tasks and the like.

BRIEF SUMMARY OF THE INVENTION

The present invention involves a armband assembly for carrying a portable radio to enable the radio to be selectively secured about and removed from a person's arm for transportation thereabout in such a position that (1) said person is able to hear the audio sounds generated by the radio directly or (2) a fixed length cord from an ear plug adapted to be retainably inserted in the person's ear is able to comfortably reach to the radio so as to be operatively coupled thereto. The armband assembly includes a first adjustably positionable strap means for encircling at least a portion of the person's arm so as to be securely carried thereby. A second strap means is fixedly secured to an intermediate portion of the first strap means for at least partially encircling the radio so as to securely position the radio with respect to the first strap means so that the person has audio access to the radio while leaving his hands normally free to perform manual tasks and the like.

The first strap means may include a band of elastic-like stretch material which expands when being fitted to the person's arm and then contracts to remain securely carried thereon. However, in the preferred embodiment of the present invention, the first strap means may include a first generally rectangular strap having opposite end portions and intermediate central portion and the first strap means may include adjustable fastening means carried by the opposite end portions of the rectangular strap for adjustably securing the first strap to various selected degrees of tightness about different diameters of arms.

The first strap may include a pad of barb-like elements secured to a first surface adjacent an end portion thereof and a mat of barb-engaging material secured to the opposite surface adjacent the opposite end portion of the first strap such that when the first strap is wrapped around a person's arm and the pad is pressed into contact with the mat, the first strap is adjustably secured in that position until force is applied to separate the pad from the mat for removal purposes. The second strap means of the present invention may include a second strap generally perpendicular to the first strap and secured thereto for at least partially encircling the radio about one of its dimensions without covering the control dolls and the jackplug. A third strap means may also be provided which is generally parallel to the first strap and perpendicular to the second strap and secured to at least one of the first or second strap for at least partially encircling the radio about another of its dimensions without covering the control dials and jackplug. Fastening means may be provided adjacent the ends of the second and third straps for retainably securing the radio at least partially enclosed within the second and third straps such that the radio may be easily transported when the first strap means is retainably secured about the person's arm.

The armband assembly of the present invention provides a simple, economical, safe means for transporting a portable radio in such a manner so as to provide the wearer with access to the audio sounds generated by the radio while leaving the person's hands free to perform manual tasks or the like. The assembly of the present invention is easy to mount, easy to adjustably position about the wearer's arm, easy to remove, and easy to maintain.

The armband assembly of the present invention provides ready access to the control dials for adjustment purposes and provides a free path so that the ear plug assembly may be operably connected to the radio with the cord extending to the wearer's ear without interference from the carrier.

The armband assembly of the present invention is selectively adjustable to fit any size of arm and to be securely retained thereon once it is adjustably mounted. Similarly, the armband apparatus provides means whereby the portable radio may be securely mounted to the first strap so that the radio will not easily become unfastened or loosened so as to fall from the assembly and become damaged or the like.

Other advantages and meritorous features of the present invention will be more fully understood from the following detailed description of the drawings in the preferred embodiment, the appended claims and the drawings, which are described briefly hereinbelow.

DESCRIPTION OF THE PREFERRED EMBODIMENT

Figure 1:
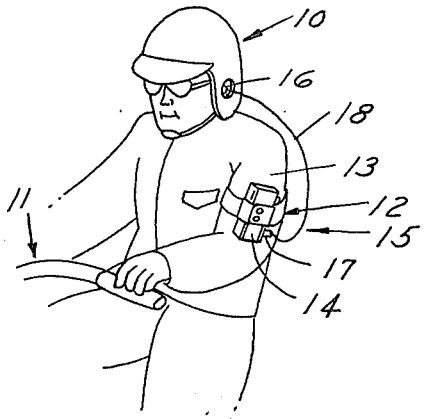
FIG. 1 is a fragmentary perspective view of a person riding a motorcycle and wearing the armband assembly of the present invention with a portable radio operatively carried thereby.
Figure 3:
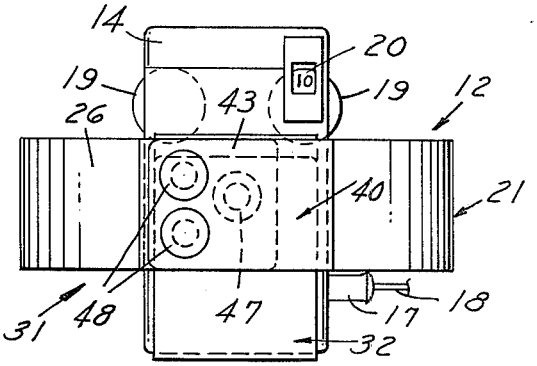
FIG. 3 is a front view of the armband assembly of FIG. 3 with all of the strap means in the fully closed or fastened position.

FIG. 1 shows a person 10 riding a motorcycle 11, only a portion of which is shown, and wearing the armband assembly 12 of the present invention about his arm 13. The armband apparatus 12 retainably mounts a portable radio 14 which includes an ear plug assembly 15 including an ear plug 16 adapted to be retainably inserted within the ear of a person 10, a jackplug 17 adapted to be operatively coupled to the radio 14, and an electrical cord 18 operatively interconnecting the ear plug 16 with the jackplug 17 so that audio sounds from the radio 12 may be transmitted to the ear of the person 10 for listening purposes.

Figure 2:
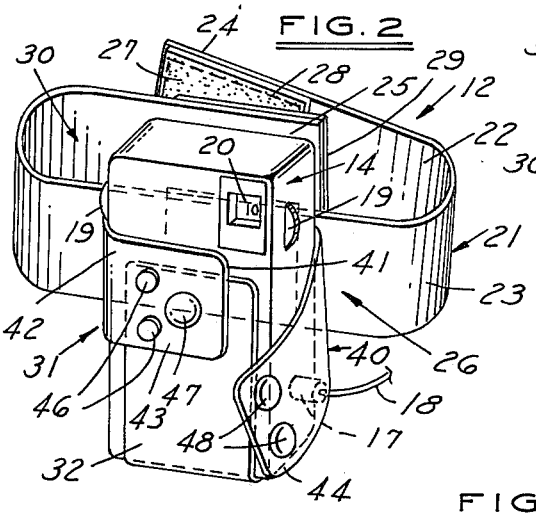
FIG. 2 is a perspective view of the armband assembly of the present invention with the portatable radio mounted therein but with one of the straps in a partially opened position.

FIG. 2 shows a perspective view of the armband apparatus 12 of the present invention carrying a radio 14 which may be a conventional, commercially available, portable transistor radio having one or more control dials 19 and an indicator 20. The radio 14 may also include a conventional socket inlet, not shown, for operatively receiving the jackplug 17, as known in the art.

The armband assembly 12 of the present invention includes a first generally rectangular strap or band 21 which, in the preferred embodiment of the present invention, includes a conventionally known elastic-like stretch material which is capable of being expanded when being fitting about the arm 13 of the person 10, but which will contract thereafter to be retainably secured tightly thereon. The first strap 21 has an inside surface 22, an outside surface 23, a first end portion 24, and opposite end portion 25, and an intermediate central portion 26 between the end portions 24, 25.

While the first strap 21 may form a continuous closed sloop and have its end portions 24 and 25 sewn together so that it may be selectively fitted over a persons arm merely by the stretch of the material included therein, in the preferred embodiment of the present invention, fastening means are provided adjacent the end portions 24, 25 for selectively adjusting the tightness of the strap 21 about the arm 13 of the person 10. While any type of conventional fastening means, such as snaps, buttons or the like may be employed, in the preferred embodiment of the present invention Velcro (trademark) fastening means are utilized. An elongated pad 27 of barb-like elements is fixedly secured adjacent the inside surface 22 of the first end portion 24 by any suitable means such as sewn stitches 28, a corresponding elongated mat 29 of barb-engaging material is fixedly secured to the outside surface 23 adjacent the opposite end portion 25 of the strap 21 by any conventional fastening means such as the sewn stitches 28 previously described.

Figure 4:
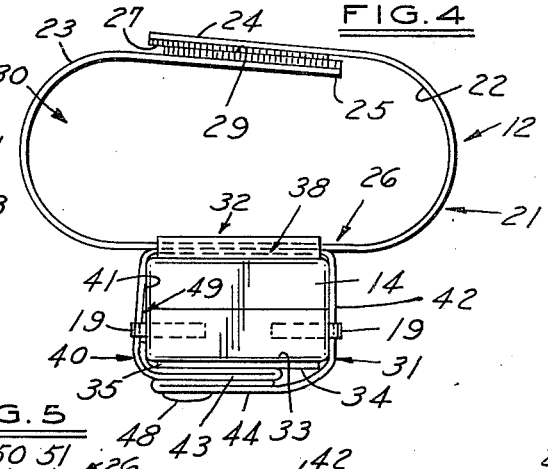
FIG. 4 is a top view of the armband apparatus of FIG. 3.
Figure 5:
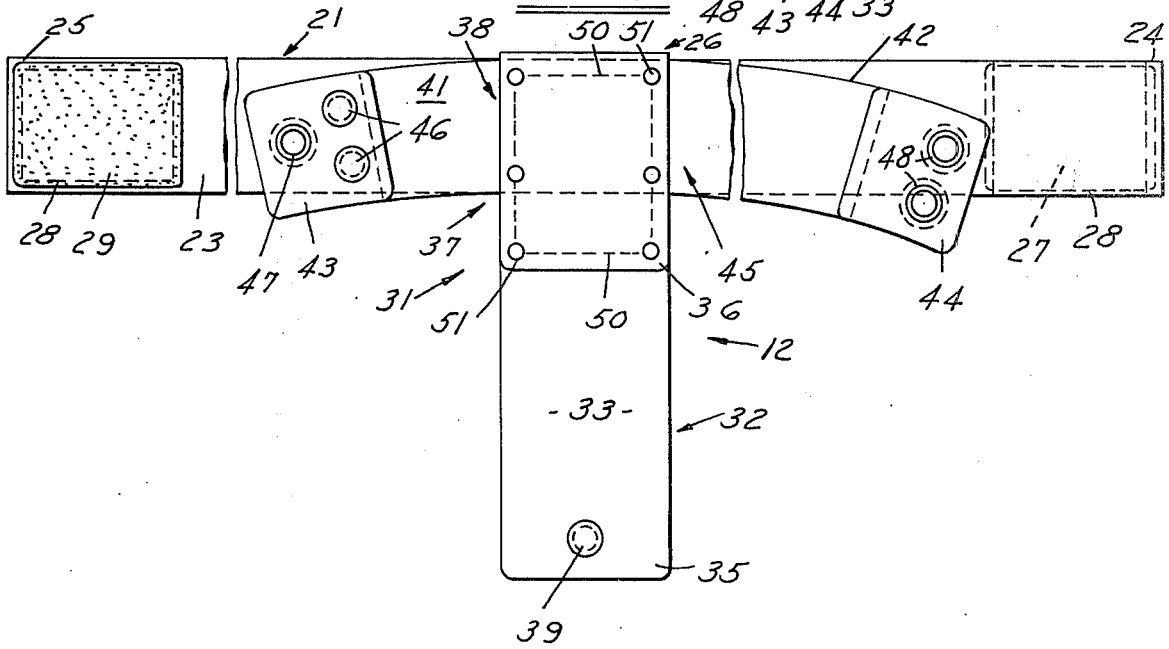
FIG. 5 is a front view of the armband apparatus of FIG. 2 with all of the strap means in the fully opened position and without the portable radio mounted therein.

In operation, the first strap 21 is wrapped about the arm 13 of the person 10 to form a closed loop as illustrated in FIG. 4 and the pad 27 of barb-like elements is pressed against the mat 29 of barb-engaging material at any selected position along the length thereof so that the loop 30 is adjustably variable in size depending upon the position of contact of the pad 27 with the mat 29 so as to retainably encircle or tightly fit nearly any diameter of arm 13.

The armband assembly 12 of the present invention also includes apparatus 31 for at least partially encircling the radio 14 so as to retainably mount the radio 14 with respect to the first strap 21. The apparatus 31 includes a second generally rectangular strap or band 32 comprising cloth-like or leather-like material. The second strap 32 has an inside surface 33, an outside surface 34, a first end portion 35, a second end portion 36, and an intermediate portion 37. In the preferred embodiment of the present invention, the second end portion 36 is folded back upon the intermediate portion 37 so as to form a partial loop portion 38, wherein the inside surface 33 of the second end portion 36 is disposed toward the inside surface 33 of the intermediate portion 37. A male snap element 39 of a conventional snap fastening means is fixedly secured adjacent the first end portion 35 of the second strap 32 such that the operative portion of the male snap element 39 extends outwardly from the outside surface 34 of the first end portion 35 of the second strap 32.

The encircling apparatus 31 also includes, in the preferred embodiment of the present invention, a third generally rectangular strap or band 40 of conventional elastic-like stretch material. The third strap 40 includes an inside surface 41, an outside surface 42, a first end portion 43, an opposite end portions 44, and an intermediate portion 45 between the ends 43 and 44. A pair of male snap elements 46 are fixedly secured adjacent the first end portion 43 of the third strap 40 such that the operative portions extend outwardly from the outside surface 42 of the end portion 43. Additionally, a female snap element 47 is fixedly secured adjacent the first end portion 43 of the third strap 40 with its operative opened portion facing outwardly from the inside surface 41 thereof.

A pair of female snap elements 48 are fixedly secured adjacent the opposite end portion 44 of the third strap 40 with their opened or operative portions facing outwardly from the inside surface 41 thereof so as to be operatively engaged by the operative portions of the pair of male snap elements 46 secured adjacent the first end portion 43 when the end portions 43, 44 are closed over one another and about the lesser dimension of the radio 14 to form a loop 49 at least partially enclosing the radio 14 without interfering with the control dials 19, indicator 20, or a socket for the jackplug 17.

The first strap 21 is fixedly secured to the second and third straps 32 and 40, respectively as described hereinbelow. Generally, the first strap 21 is parallel to the third strap 40 and both the first strap 21 and third strap 40 are generally perpendicular to and form a T-configuration with the second strap 32.

The intermediate central portion 26 of the first strap 21 is received within the partial loop portion 38 of the second strap 32 such that the inside surface 22 of the first strap 21 is disposed against the inside surface 33 of the intermediate portion 37 of the partial loop 38 of the second strap 32 while the outside surface 23 of the first strap 31 is disposed facing the inside surface 33 of the second end portion 36 of the strap 32 which forms the second half of the partial loop 38. The third strap has its intermediate portion 45 disposed within the partial loop 38 of the second strap 32 such that the outside surface 42 is disposed against the outside surface 23 of the first strap 21 while the inside surface 41 faces outwardly and is disposed against the inside surface 33 of the second end portion 36 of the partial loop portion 38 of the second strap 32.

In the preferred embodiment of the present invention, the partial loop 38 of the second strap 32 is fixedly secured to the intermediate portions 26 and 45 of the first strap 21 and third strap 40 respectively by any type of conventional means such as stitches 50 and/or rivets 51. Once secured, the first, second and third straps 21, 32, and 40, respectively, form a generally T-shape configuration fixedly secured about the intersecting portions but having the end portions 24, 25, 43, 44 and 35 free to move with respect to the secured portions 26, 38 and 45.

The operation of the encircling apparatus 31 of the present invention is briefly described hereinbelow. The radio 14 is placed with its back disposed against the outside surface 34 of the second end portion 36 forming the partial loop 38 of the second strap 32 and the first end portion 35 of the perpendicular second strap 32 is folded over the greater dimension of the radio 14 so as not to block or obstruct the socket to the jackplug 17 and to lie over the front of the radio 14 without obstructing the control dials 19 or the indicator 20. The first end portion 43 of the third strap 40 is then folded over the outside surface 34 of the first end portion 35 of the second strap 32 which was previously folded over the front of the radio 14 and the female snap element 47 is pressed down over the male snap element 39 so that their operative portions interlock in a conventional snap fastener manner.

The opposite end portion 44 of the third strap 40 is then folded over the front of the radio 14 to overlap the outside surface 42 of the first end portion 43 of the third strap 40 and the pair of female snap elements 48 which is secured to the opposite end portion 44 is pressed down upon the corresponding pair of male snap elements 46 which is secured to the first end portion 43 so that their operative portions interlock in a conventional snap fastening manner. The third strap 40 does not obstruct the socket for the jackplug 17 nor does it obstruct or interfere with access to the control dials 19 or the visual indicator 20. However, the interlocking of the second strap 32 and the third strap 40 enables the radio 14 to be at least partially encircled and retainably secured or mounted to the first strap 21 so as to enable the radio 14 to be transportively carried on the arm 13 of a person 10 when the first strap 21 is retainably secured to or about the arm 13 by snuggly encircling the same.

The armband assembly 12 of the present invention may be secured about the upper portion of the arm 13 so that the radio is transported in such a position that the sound generated by the radio may be heard directly by the person 10 and/or such that the fixed length electrical cord 18 is able to comfortably reach from the ear plug 16 which is adapted to be retainably inserted in the ear of the person 10 while the jackplug 17 mounted on the opposite end thereof is operatively connected to the socket of the radio 14 so as to supply the audio sounds from the radio 14 to the ear of the person 10, as desired.

The armband assembly 12 of the present invention is simple, relatively inexpensive, easy to mount and remove. Additionally, it is relatively safe and easy to carry, it leaves the hands of the person 10 free to perform other tasks, and it affords considerable protection to the radio 14 since the radio 14 is relatively securely mounted to the first strap 21 by the second and third straps 32 and 40 and since the first strap 21 can be securely positioned about the arm 13 of the person 10.

With this detailed description of this specific apparatus used to illustrate the prime embodiment of the present invention and the operation thereof, it will be obvious to those skilled in the art the various modifications can be made and the present apparatus and in the configuration and materials recited herein without departing from the spirit and scope of the invention which is limited only by the appended claims.

I claim:

1. An apparatus for enabling a person to carry a portable radio having control dials and an ear plug assembly including an ear plug adapted to be inserted in said person's ear for conveying audio sounds thereto, a jack unit adapted to be plugged into said radio and a cord having a fixed predetermined length for operatively connecting said jack unit to said ear plug for conveying radio signals thereto, said apparatus comprising a first adjustably positionable strap means for retainably encircling said person's arm so as to be transportively carried thereon and means retainably secured to said first strap means for at least partially enclosing said radio and transportively mounting same to said first strap means such that said control dials are readily accessible for adjustment by said person and such that said cord of a predetermined fixed length comfortably reaches from said partially enclosed transportively mounted radio to said ear plug inserted in said person's ear when said first strap means is adjustably positioned to be retainably carried on said person's arm while leaving said person's hands normally free, wherein said first adjustably positionable strap means includes a first band of generally elastic stretch material which stretches when being fitted on said person's arm then contracts to retainably encircle said arm to be carried thereby and said means for partially enclosing said radio and transportively mounting same includes at least a second strap means of generally elastic material which stretches when being fitted about said radio and then contracts to at least partially retainably secure same with respect to said first strap means, said first band of generally elastic material includes a first elongated strip having opposite end portions and an intermediate portion and said first strap means further includes fastening means adjacent said end portions for enabling said first band to be selectively secured at a plurality of different positions depending upon the diameter of said person's arm, and wherein said second strap means having opposite end portions and an intermediate portion, said second strap means having fastening means adjacent said end portions of said second strap means for enabling said second strap means to be retainably secured at least partially about said radio, said intermediate portion of said second strap means being retainably secured to said intermediate portion of said first elongated strip, a third flexible strap means generally perpendicular to the length of said first strap means for at least partially encircling the lower portion of said radio, wherein said third strap means having one end portion folded over itself to form a loop adjacent said one end portion thereof, said loop being adapted to receive therethrough said intermediate portion of said first strap means such that said third strap means is generally perpendicular to said first strap means and forms a T-like configuration therewith, said third strap means further including means for fixedly securing said first, second, and third strap means together proximate said loop.

2. The radio mounting apparatus of claim 1 wherein said first strap means includes means for selectively adjusting the closed length thereof so as to vary the tightness and looseness of fit on said person's arm.

3. The radio mounting apparatus of claim 2 wherein said first flexible strap means includes a generally rectangular strap having one surface portion adjacent one end thereof provided with flexible barb-like members extending outwardly therefrom and the opposite surface portion adjacent the opposite end thereof provided with a mat of barb-engaging material to allow said strap to be adjustably positioned on said person's arm.

4. An armband assembly for carrying a portable radio to enable said radio to be selectively secured about and removed from a person's arm for transportation thereabout in such a position that said person is normally able to hear the audio sounds generated by the radio both directly and via a fixed length cord from an ear plug adapted to be retainably inserted in said person's ear, said armband assembly comprising first adjustably positionable strap means for encircling at least a portion of said person's arm so as to be secured and carried thereby, and second strap means fixedly secured to an intermediate portion of said first strap means for at least partially encircling said radio so as to secure the position thereof with respect to said first strap means, said first strap means including a band of elastic-like stretch material which expands when being fitted to said person's arm and then contracts to remain securely carried thereon, said first strap means including a first generally rectangular strap having opposite end portions and an intermediate central portion, said first strap means further including adjustable fastening means carried by said opposite end portions for adjustably securing said first strap to various selected degrees of tightness about different diameters of arms, a third generally rectangular strap comprising elastic-like stretch material and having an intermediate portion and opposite end portions, fastening means carried by one end of said second strap and both end portions of said third strap, means on the opposite end portion of said second strap for fixedly securing said first, second, and third straps together proximate said intermediate central portion of said first strap such that said second strap is generally perpendicular to said first strap and forms a T-like configuration therewith and said third strap being generally parallel to said first strap, said second and third straps being operatively joined to at least partially enclose said radio and securely hold said radio with respect to said first strap.

5. The armband assembly of claim 4 wherein said adjustable fastening means includes a pad of barb-like elements secured to a first surface adjacent on end portion of said first strap and a mat of barb-engaging material secured to the opposite surface adjacent the opposite end portion of said first strap such that when said first strap is wrapped about said person's arm and said pad is pressed into contact with said mat, said first strap is secured in that position until force is applied to separate said pad from said mat for removal purposes.

* * * * *